United States Patent [19]

Moreland

[11] Patent Number: 4,763,366

[45] Date of Patent: Aug. 16, 1988

[54] COMBINED DRAIN AND RETURN LINE AND VALVE THEREFOR

[75] Inventor: Gerald W. Moreland, Garden Grove, Calif.

[73] Assignee: Honiton Investments, N.V., Netherlands Antilles

[21] Appl. No.: 831,366

[22] Filed: Feb. 18, 1986

[51] Int. Cl.[4] ..... E03C 1/02; A61H 33/02

[52] U.S. Cl. ..... 4/541; 4/191; 4/199; 4/542; 4/544; 128/66

[58] Field of Search ..... 4/541, 542–544, 4/191, 192, 206, 199, 202, 201, 203, 204, 206; 128/66; 239/504, 568, 601, 596, 598

[56] References Cited

U.S. PATENT DOCUMENTS

| | | | |
|---|---|---|---|
| 2,607,045 | 8/1952 | Morris | 4/199 |
| 3,159,849 | 12/1964 | Jacuzzi | 4/180 |
| 3,263,678 | 8/1966 | Everston | 128/66 |
| 3,266,737 | 8/1966 | Nees | 239/548 |
| 3,287,741 | 11/1966 | Nash | 4/180 |
| 3,288,134 | 11/1966 | Reich | 128/66 |
| 3,302,640 | 2/1967 | Jacuzzi | 128/66 |
| 3,307,206 | 3/1967 | Kreuger | 4/199 |
| 3,319,266 | 5/1967 | Schneider et al. | 4/180 |
| 3,345,982 | 10/1967 | Guiler | 128/66 |
| 3,391,411 | 7/1968 | Miller, Jr. | 128/66 X |
| 3,474,469 | 10/1969 | Steltz | 4/544 |
| 3,571,820 | 3/1971 | Jacuzzi | 4/180 |
| 3,591,872 | 7/1971 | Vanegas et al. | 4/180 |
| 4,563,780 | 1/1986 | Pollack | 4/191 X |

*Primary Examiner*—Henry K. Artis

*Attorney, Agent, or Firm*—Knobbe, Martens, Olson & Bear

[57] ABSTRACT

A bath, into which water is to be pumped for hydrotherapy, is disclosed and in which the drain and overflow pipes from the bath and the return line to the pump are connected to a junction leading to a waste pipe. A valve in the junction directs water from the drain pipe to the return pipe but not to the waste pipe while allowing overflow water to flow into the waste pipe. After the bath has been used, the valve may be opened to drain the bath, drain and return pipes to waste.

23 Claims, 3 Drawing Sheets

COMBINED DRAIN AND RETURN LINE AND VALVE THEREFOR

BACKGROUND OF THE INVENTION

This invention is concerned with a hydrotherapeutic bathing apparatus in which the drain, overflow and pump return lines are conveniently and simply connected together while maintaining open the overflow passage to a waste pipe. The invention also embraces a novel valve arrangement for such a system.

Hydrotherapeutic baths are well known and are becoming more popular, particularly in domestic baths where the whirlpool action of the water is found to be relaxing and enjoyable. New whirlpool baths and their associated plumbing are, however, relatively expensive and the replacement in the home of existing baths is also relatively time consuming and inconvenient.

Hydrotherapeutic baths typically comprise a drain line connected to the bath's outlet, an overflow line connected to the bath's overflow outlet and a pumped water circulation system which typically takes water draining through the drain line and returns it to the bath under pressure to generate the whirlpool and massaging effect in the water. In such apparatus it is necessary to close off the drain line to the waste line, which leads to the sewer system, so that water is not lost from the bath during this cycling procedure while the bath is in use. However, such an arrangement can also seal off the overflow line and render it inoperative during use of the bath. Clearly this is undesirable.

U.S. Pat. No. 3,319,266 to Schneider discloses a hydrotherapy apparatus in which a conventional overflow gate valve closes the drain line to waste while pumped water is taken from and returned to the drain line between the bat outlet and the gate valve to feed a nozzle-riser assembly which projects up through the drain outlet of the bath. Such an arrangement blocks the overflow passage during use of the bath and the nozzle assembly projecting into the bath is obstructive to users and is unsightly.

U.S. Pat. No. 3,345,982 to Guiler discloses a similar arrangement in which the drain pipe is closed to the waste pipe by a conventional gate valve in the overflow line.

U.S. Pat. No. 3,159,849 to Jacuzzi discloses an arrangement in which a hollow gat valve in the overflow passage keeps the overflow open at all times and a separate valve in the drain line either directs water from the pump back to the bath or to the pump. This system is relatively complex and does not lend itself to convenient installation or the modification of existing baths and moreover also suffers from the drawback of having the nozzle-riser assembly projecting upwardly through the bath drain outlet.

U.S. Pat. No. 3,571,820 to Jacuzzi discloses a hydrotherapeutic bath in which a downwardly extending hollow fitting is connected to the bath outlet, the pump return line and a drain conduit which is, in turn, connected to the overflow and waste line. A valve operated by a linkage through the overflow line opens and closes the base of the fitting to either cause recirculation of the water or to drain it to waste.

The arrangements in all the above-referenced patents require a relatively large space beneath the bath in order to accommodate the plumbing. This can be very inconvenient to install or even impractical where little space is available under the bath, for example between floors or particularly where the bath is placed on a concrete slab floor.

There is therefore a need for a hydrotherapeutic bathing apparatus in which the drain, pump, overflow and waste lines are connected together in a simple fashion in such a manner that the overflow is continuously functional and which is particularly adapted to the simple modification of existing bath installations.

SUMMARY OF THE INVENTION

According to the invention there is provided a hydrotherapeutic apparatus comprising:

- a tub having upright walls and a bottom wall, said bottom wall having a drain outlet and at least one of said upright walls having an overflow outlet;
- a drain pipe connected to said drain outlet;
- an overflow pipe connected to said overflow outlet;
- a pump having an intake and a discharge;
- means for conducting water from said pump discharge to said tub and for agitating the water therein when said apparatus is in use for hydrotherapy;
- a conduit for conducting water from said tub to said pump intake;
- a junction joining said drain pipe, overflow pipe and said conduit together and having walls defining an internal chamber;
- a waste pipe connected to said junction;
- a fluid passage through said junction for establishing fluid communication between said drain pipe and said conduit when said apparatus is in use;
- a valve in said chamber which is movable from a first position, in which said drain pipe is in fluid communication with said conduit and said drain pipe and said conduit are closed to said waste pipe, to a second position in which said drain pipe and said conduit are open to said waste pipe;
- said junction having an overflow passage therethrough so that said overflow pipe is in fluid communication with said waste pipe, irrespective of the position of said valve.

The invention also provides a method of maintaining open the overflow line of a bath to a waste line connected to the sewer system while the bath is in use for hydrotherapy and water from the bath is returned to the bath by a pump, via a drain line from the bath and a return line to said pump, said method comprising in a junction, to which is connected said overflow, waste, drain and return lines, directing water from said drain line to said return line but not to said waste line while said bath is in said use, while, in said same junction, simultaneously connecting said overflow line to said waste line.

Preferably the valve has a wall which in combination with at least one of the walls of the junction defines said fluid passage. More preferably the valve has a fluid passage therethrough for establishing fluid communication between the drain pipe and the conduit. Preferably the valve and chamber are generally cylindrical in shape and the fluid passage comprises a cavity, preferably semi-cylindrical in shape, in one side of the valve, which is open to both the drain pipe and the conduit when the valve is in the first position. Preferably the overflow passage extends through the valve and is also semi-cylindrical in shape.

In another embodiment, this invention embraces the above-described valve. Thus the invention also provides a valve for a hydrotherapy bath which comprises a body having a cavity in one side thereof and a passage therethrough, such that when the valve is in place between the drain and return lines of the bath and between overflow and waste lines, the cavity allows water to pass from the drain line to the return line, but not to the waste line, while any water overflowing from the bath through the overflow line is allowed to pass to the waste line through the passage through the valve.

The invention also embraces a housing having separate connections for a bath overflow, a bath drain, a pump return line, and a sewer line; and a valve body, movably mounted within said housing;

passages in said housing for providing two operational modes:

a first mode in which said drain, return line and overflow are connected to said sewer line, and a second mode in which said drain is connected exclusively to said return line while said overflow is connected to said sewer line.

Thus this invention provides means for simply connecting the drain, return, overflow and waste lines in a bathing installation and is particularly suited to the adaptation of conventional baths, pools and the like to form a hydrotherapy or whirlpool bath with the minimum amount of construction. By means of the valve assembly in this invention, such a conversion may be accomplished without excavating below the bath to accommodate bulky plumbing extensions. Preferably, the drain conduit is a single pipe and the only pipe underneath the bath so that very little space is required under the bath for the plumbing in this invention. Moreover this invention provides a system which uses a single junction and single valve arrangement for these lines, thereby providing significant advantages of simplicity and costs savings over the prior art arrangements. Preferably the the pipes and fittings except the junction are standard, thereby allowing easy adaptation of existing, standard plumbing.

BRIEF DESCRIPTION OF THE DRAWINGS

Some preferred embodiments of the invention are illustrated in and by the accompanying drawings in which.

DETAILED DESCRIPTION OF THE DRAWINGS

Figure 1:
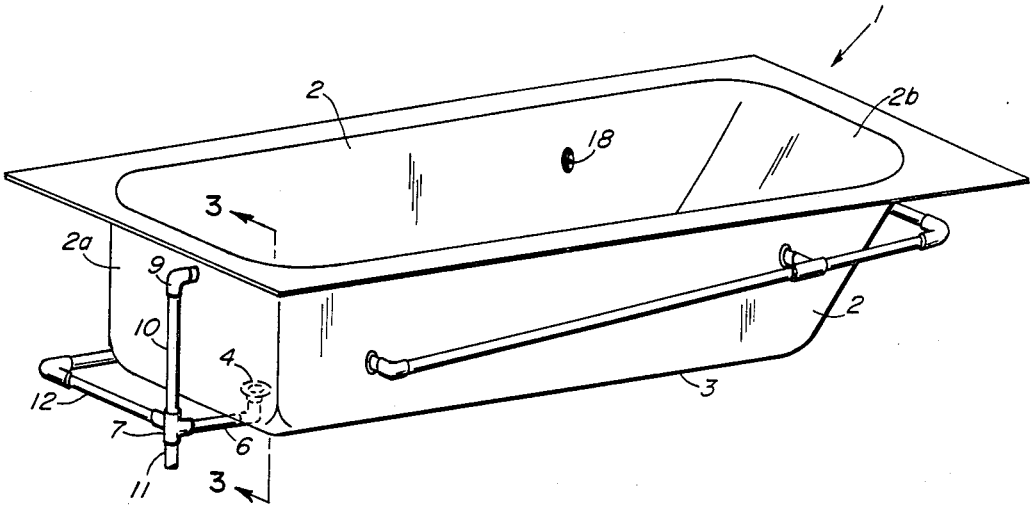
FIG. 1 is a perspective view of a hydrotherapy bath apparatus according to this invention.
Figure 2:
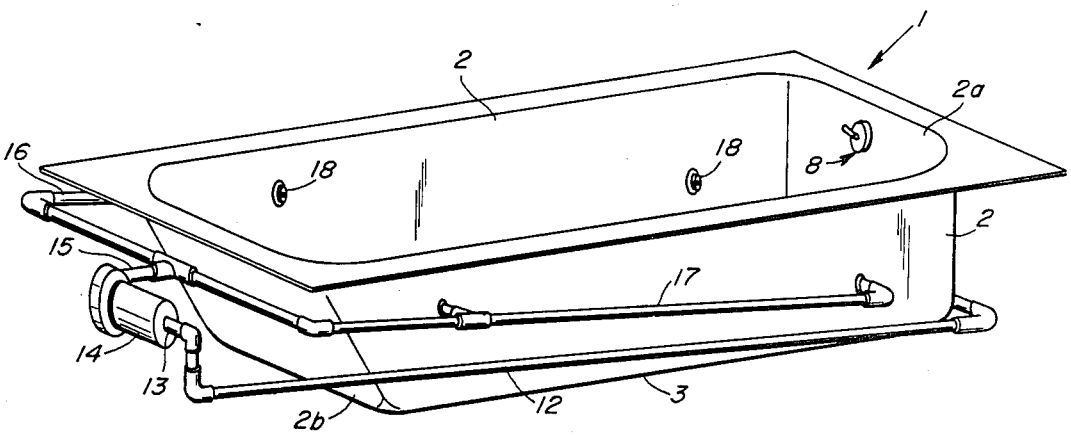
FIG. 2 is a perspective view of the bath of FIG. 1 taken from the opposite side.

Referring to FIGS. 1 and 2, there is shown a bath 1 having sidewalls 2 and a bottom 3. As is conventional, the side wall 2*a* adjacent to the faucets (not shown) is substantially vertical and the sidewall 2*b* at the opposite end of the bath slopes inwardly towards the bottom wall 3. A drain hole 4 in the bottom 3 of the bath is adjacent vertical sidewall 2*a* and is connected by an elbow 5 to a drain pipe 6 which projects out from beneath bath 3 and terminates in a junction 7. An overflow 8 (FIG. 2) in vertical sidewall 2*a* is connected by an elbow 9 on the outside of the bath to an overflow pipe 10 which projects downwardly into fluid communication with junction 7. As shown in FIG. 1, a waste pipe 11, connected to the sewer system (not shown), projects downwardly from junction 7 in substantial alignment with overflow pipe 10. A conduit return line 12 is connected to junction 7 at substantially a 90% angle to both drain pipe 6 and overflow pipe 10. As shown in FIG. 2, return line 12 extends along the outside of the length of the bath and is connected to the intake 13 of a pump 14 located outside of the bath and adjacent sloping vertical wall 2*b*. Pump 14 could be located at the other end of the bath, i.e. adjacent vertical wall 2*a*, or even underneath the bath, but it is preferred for convenience and for the optimum utilization of space to place the pump in the location shown in FIG. 2 because that location provides the largest space between the bath, floor and surrounding walls. Pump 14 is usually placed on a support (not shown). Pump 14 has a discharge 15 which is connected to lines 16 and 17 which extend along the outside of the bath, one each side, and project through it at nozzle locations 18. As is well known water and air bubbles are supplied to the bath to cause the massaging action in the water in the bath. For simplicity the air jets are not shown in FIGS. 1 and 2.

Figure 3:
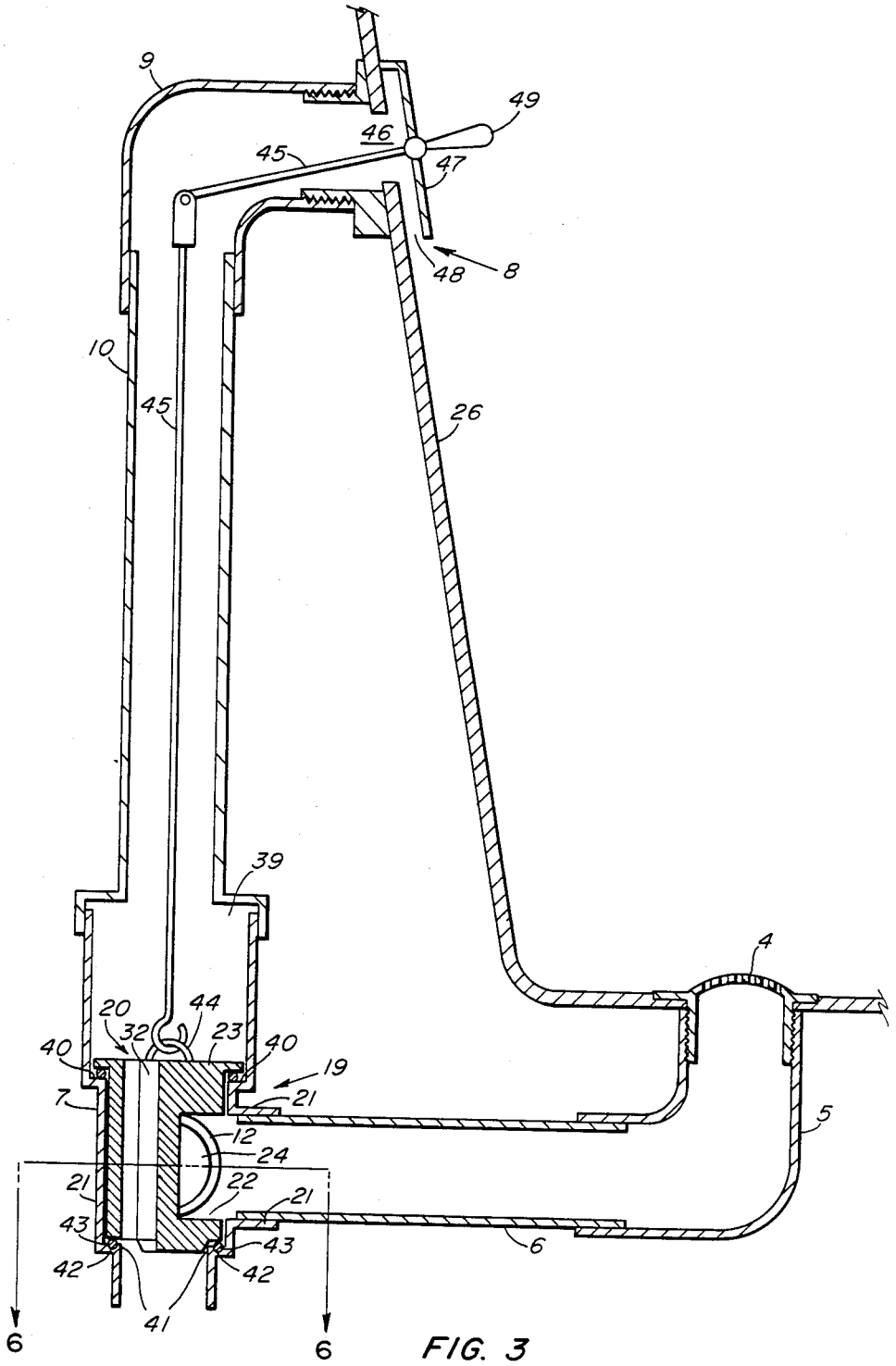
FIG. 3 is a partial cross-sectional view taken along line 3—3 in FIG. 1 and viewed in the direction of the arrows and showing the valve in this invention.

The novel valving arrangement of this invention can be seen more clearly in FIG. 3, where there is shown in cross-section the valve assembly 19 of this invention. Valve assembly 19 comprises a junction 7 which contains a valve member 20. Walls 21 of junction 7 define a generally cylindrical internal chamber 22 in which valve member 20 is located.

Figure 4:
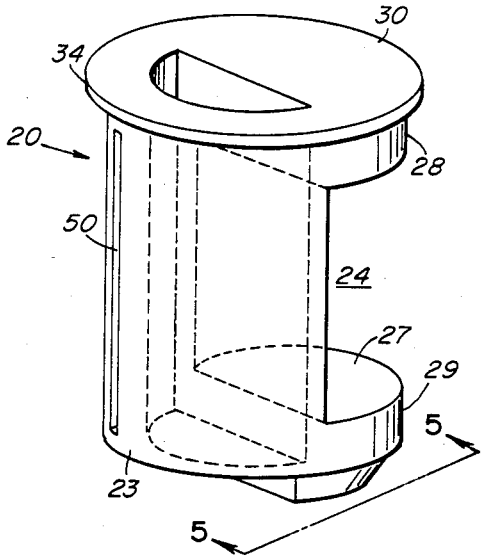
FIG. 4 is a perspective view of the valve of this invention.
Figure 5:
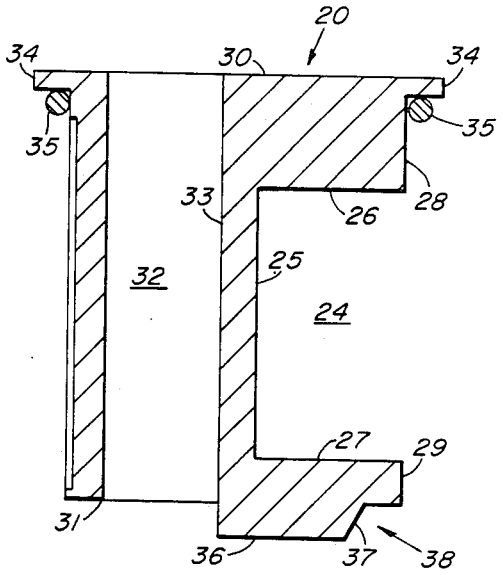
FIG. 5 is a cross-sectional view of the valve of FIG. 4, taken along line 5—5 and viewed in the direction of the arrows.

The shape of valve member 20 can be seen more clearly in FIGS. 4 and 5. There it is shown that valve member 20 comprises a generally cylindrical walled body 23 sized to fit in the cylindrical chamber 22 of junction 7, as shown in FIG. 3. Member 20 has a generally semi-cylindrical cut-out cavity 24 in one side. As can best be seen in FIG. 4, cut-out 24 provides a substantially rectangular, flat wall 25 within the periphery of body 23 and lying in a plane parallel to the longitudinal axis of cylindrical body 23. Opposing semi-circular surfaces 26 and 27 complete semi-cylindrical cut-out 24 and are located under a semi-cylindrical overhang 28 and on a semi-cylindrical projection 29, respectively. Extending through body 23 from its upper end 30 to its lower end 31 is a generally semi-cylindrically shaped passage 32 having a substantially rectangular, flat wall 33 (FIG. 5) substantially parallel to wall 25. Upper end 30 projects beyond the walls of body 23 to form an outwardly extending flange 34 which retains below it a resilient O-ring seal 35 as shown in FIG. 5. Wall 33 of passage 32 projects beyond the bottom surface 31 of valve member 23 to form under projection 29 a substantially semi-circular rib 36 having a sloped surface 37 around its curved periphery which forms with the underside of projectio 29 a valve seat 38.

Referring again to FIG. 3, it is shown that walls 21 at the upper end of chamber 22 extend outwardly to form an enlarged chamber 39, thereby providing an annular shelf 40 against which the O-ring seal 35 of valve member 20 may be seated, as shown in FIG. 3. The lower ends of walls 21 project radially inwardly to form an annular shelf 41 into which is cut an annular channel 42 containing a resilient O-ring seal 43 against which the bottom surface 31 and valve seat 38 of valve member 20 can be seated, as shown in FIG. 3.

The upper surface 30 of valve member 20 has means such as the ring 44 shown in FIG. 3, attached at the center of that surface to which is connected a linkage 45 which extends up overflow pipe 10 to project through wall 2*a* of the bath at overflow outlet 46. A decorative cover plate 47 covers outlet 46 on the inside of the bath and provides an opening 48 between plate 47 and wall 2*a* of the bath to allow fluid communication through overflow outlet 46 to overflow pipe 10. Mounted in cover 47 is a lever 49 for manual operation of the linkage and thereby valve 20. It will be appreciated, however, that this is but one example of a conventional means for raising and lowering valve 20. Any other conventional means, for example one which moves linkage 45 by a camming action, may be used instead of the arrangement exemplified.

Thus, referring to FIG. 3, when the bath is in use, water from the bath drains along drain pipe 6 and into the cut out portion 24 of valve member 20 where it impinges on wall 25 and is directed thereby into conduit 12 towards pump 14 for recirculation to the bath. As can best be seen in FIG. 6, wall 25 of cut-out 24 is arranged at substantially a 45° angle to the axes of bath drain pipe 6 and conduit 12 and therefore effectively deflects water from one pipe to the other. In the position of valve 20 shown in FIGS. 3 and 6, because valve member 20 is sealed at its lower surface 31 by seal 43, water cannot escape down waste pipe 11 and similarly because the upper end 32 of valve member 20 is sealed by seal 35, water cannot escape upwardly into overflow pipe 10. However, should too much water be allowed into the bath it can overflow through overflow passage 46 and overflow pipe 10 through overflow passage 32 in valve 20 and into waste pipe 11 and into the sewer system. Thus the overflow remains operational while the bat is in use.

When it is desired to empty the bath and cease hydrotherapy, lever 49 is pushed downwardly to pull valve member 20 upwardly off seal 43 to open drain pipe 6 and conduit 12 to the waste pipe 11. It will be noted from FIGS. 1 and 2 that return line 12, lines 16 and 17 are each angled downwardly so that after use, all plumbing will drain completely so that no bath water remains either in the bath or in the plumbing. This is desirable for health purposes and for minimizing pipe corrosion.

Figure 6:
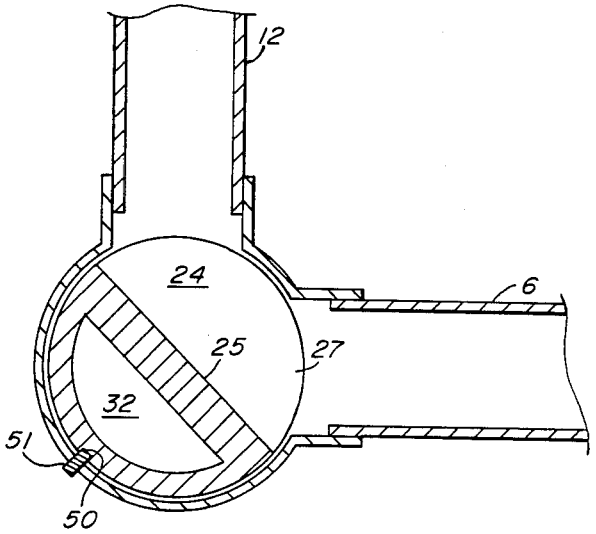
FIG. 6 is a cross-sectional view of the valve of along line invention, in place in the hydrotherapy bath and taken along line 6—6 in FIG. 3 and viewed in the direction of arrows.

To control the movement of the valve member 20 and to maintain its orientation in junction 7 as shown in FIG. 6, the outer wall of member 20 has narrow vertical channel 50, as shown in FIG. 4, into which a locating pin 51 (FIG. 6) projects through side wall 21 of chamber 22. As valve member 20 is moved upwards or downwards for opening or sealing drain pipe 11, pin 51 travels along channel 50 to prevent valve member 20 from rotating about its longitudinal axis and hereby maintains the correct orientation of the water deflecting surface 25 of valve 20 to the water flow path while the bath is in use.

I claim:

1. A hydrotherapeutic apparatus, comprising:

a tub having upright walls and a bottom wall, said bottom wall having a drain outlet and at least one of said upright walls having an overflow outlet;

a drain pipe connected to said drain outlet;

an overflow pipe connected to said overflow outlet;

a pump having an intake and a discharge;

means for conducting water from said pump discharge to said tub and for agitating the water therein when said apparatus is in use for hydrotherapy;

a conduit for conducting water from said tub to said pump intake;

a junction joining said drain pipe, overflow pipe and said conduit together and having walls defining an internal chamber;

a waste pipe connected to said junction;

a fluid passage through said junction for establishing fluid communication between said drain pipe and said conduit when said apparatus is in use;

a valve in said chamber which is movable from a first position, in which said drain pipe is in fluid communication with said conduit and said drain pipe and said conduit are closed to said waste pipe, to a second position in which said drain pipe and said conduit are open to said waste pipe;

said conduit terminating at said valve; and said junction having an overflow passage therethrough so that said overflow pipe is in fluid communication with said waste pipe, irrespective of the position of said valve.

2. An apparatus as claimed in claim 1, wherein said valve has a wall which, in combination with at least one of said walls of said junction, defines said fluid passage.

3. An apparatus as claimed in claim 1, wherein said valve has said fluid passage therethrough for establishing said fluid communication between said drain pipe and said conduit.

4. An apparatus as claimed in claim 1, wherein said overflow passage extends through said valve.

5. An apparatus as claimed in claim 1, wherein said valve and said chamber are generally cylindrical in shape and said fluid passage comprises a cavity in one side of said valve, said cavity being open to both said drain pipe and said conduit when said valve is in said first position.

6. An apparatus as claimed in claim 5, wherein said cavity has a generally semi-cylindrical shape having a flat, substantially rectangular wall lying in a plane substantially parallel to the longitudinal axis of said valve.

7. An apparatus as claimed in claim 6, wherein said drain pipe and said conduit each have longitudinal axes and, when said valve is in said first position, said substantially rectangular wall is in a plane substantially at a 45° angle to each of said axes of said drain pipe and conduit.

8. An apparatus as claimed in claim 4, wherein said overflow passage has a generally semi-cylindrical shape.

9. An apparatus as claimed in claim 1, wherein said valve has an upper end and a lower end, said junction and said valve having means for sealing the periphery of said valve adjacent said upper end to said junction and said overflow pipe and means for sealing the periphery of said valve adjacent said lower end to said junction and said waste pipe when said valve is in said first position.

10. An apparatus as claimed in claim 9, wherein said upper sealing means comprises a resilient O-ring around the upper periphery of said valve.

11. An apparatus as claim in claim 10, wherein said upper periphery has an annular flange projecting radially therefrom, said O-ring being seated against said flange.

12. An apparatus as claimed in claim 9, wherein the lower portion of said chamber has an annular shelf projecting inwardly from said walls of said junction, said lower sealing means comprising a resilient O-ring on said shelf.

13. An apparatus as claimed in claim 1, further comprising:

means for locating said valve in said junction.

14. An apparatus as claimed in claim 13, wherein said locating means comprises:

a pin extending through the walls of said chamber;

a longitudinal groove on said valve;

said pin moving along said groove as said valve moves between said first and second positions.

15. An apparatus as claimed in claim 1, further comprising:

a linkage extending through said overflow pipe from said bath to said valve;

means for attaching said linkage to said valve; and means, inside said bath and connected to said linkage, for causing said valve to move between said first and second positions.

16. An apparatus as claimed in claim 1, wherein said upright walls comprise opposing side walls and said means for conducting and agitating comprises plural conduits connected to plural nozzles, each of said side walls having at least one of said conduits extending along the exterior thereof with said nozzles projecting through said side walls.

17. A method of maintaining open the overflow line of a bath to a waste line connected to the sewer system while the bath is in use for hydrotherapy and water from the bath is returned to the bath by a pump via a drain line from the bath and a return line to said pump, said method comprising: in a junction, where said overflow, waste, drain and return lines meet, wherein said return line terminates at the meeting of said overflow, and waste lines in said junction, directing water from said drain line to said return line but not to said waste line while said bath is in use, while, in said same junction, simultaneously connecting said overflow line to said waste line.

18. A method of recirculating water from the drain pipe of a hydrotherapy bath via a return pipe and a pump to said bath, while maintaining an overflow pipe from said bath open to a waste pipe, wherein each of said drain and return pipes have longitudinal axes meeting at substantially 90°, said method comprising placing in the path of said water a member having a deflecting surface arranged at an angle to each of said axes, said surface, in use, directing said water from said drain pipe to said return pipe, said member further comprising a passage therethrough in fluid communication with said overflow and waste pipes while said water is being deflected by said surface.

19. A method as claimed in claim 18, wherein said angle is substantially 45°.

20. A bath installation comprising:

a bath tub having upright side walls and a bottom wall; said bottom wall having a drain outlet;

a drain conduit in fluid communication with said outlet;

a conduit in fluid communication with a sewer system;

an overflow conduit in continuous fluid communication between said tub and said sewer conduit;

a pump for circulating water in said tub; and a return conduit for conducting water from said drain conduit to said pump for said circulation;

said drain conduit being a single conduit and the only conduit, underneath said bottom wall and projecting therefrom for selective fluid communication with said sewer conduit and said return conduit so that, in use, water can be directed from said drain conduit either to said return conduit or to said sewer conduit.

21. An installation as claimed in claim 20, wherein said drain, sewer, overflow and return conduits are standard-sized pipes.

22. A hydrotherapeutic apparatus, comprising:

a tub having upright walls and a bottom wall, said bottom wall having a drain outlet and at least one of said upright walls having an overflow outlet;

a drain pipe connected to said drain outlet;

an overflow pipe connected to said overflow outlet;

a pump having an intake and a discharge;

means for conducting water from said pump discharge to said tub and for agitating the water therein when said apparatus is in use for hydrotherapy;

a conduit for conducting water from said tub to said pump intake, wherein each of said drain and conduit pipes have longitudinal axes meeting at substantially 90°;

a waste pipe connected to said junction;

a fluid passage through said junction for establishing fluid communication between said drain pipe and said conduit when said apparatus is in use;

a valve body in said chamber which is movable from a first position in which said drain pipe is in fluid communication with said conduit, and said drain pipe and said conduit are closed to said waste pipe, and in which said valve body forms a fluid deflecting surface arranged at an angle to each of said axes, to a second position in which said drain pipe and said conduit are open to said waste pipe; and said junction having an overflow passage therethrough so that said overflow pipe is in fluid communication with said waste pipe, irrespective of the position of said valve body.

23. An apparatus as claimed in claim 22, wherein said angle is substantially 45°.

* * * * *